United States Patent [19]

Schaulin et al.

[11] Patent Number: 4,674,393

[45] **Date of Patent: * Jun. 23, 1987**

[54] MARINE FIRING WEAPON FOR FIGHTING AIRBORNE TARGETS, ESPECIALLY IN ZENITH

[75] Inventors: Jean-Michel Schaulin, Geneva, Switzerland; Robert Gantin, Marival Chens/Leman, France; Yäsar Kanat, Geneva, Switzerland

[73] Assignee: Werkzeugmaschinenfabrik Oerlikon-Bührle AG, Zurich, Switzerland

[ * ] Notice: The portion of the term of this patent subsequent to Sep. 4, 2001 has been disclaimed.

[21] Appl. No.: 629,246

[22] Filed: Jul. 9, 1984

Related U.S. Application Data

[63] Continuation-in-part of Ser. No. 263,035, May 11, 1981, Pat. No. 4,469,005.

[30] Foreign Application Priority Data

May 23, 1980 [CH] Switzerland ..... 4037/80

[51] Int. Cl.[4] ..... F41D 10/14

[52] U.S. Cl. ..... 89/33.14; 89/33.5; 89/41.14

[58] Field of Search ..... 89/33.02, 33.1, 33.14, 89/33.16, 33.17, 33.5, 37.02, 41.14

[56] References Cited

U.S. PATENT DOCUMENTS

| | | | |
|---|---|---|---|
| 2,483,334 | 9/1949 | D'Assis-Fonseca et al. | 89/33.14 |
| 2,550,837 | 5/1951 | MacKenzie | 89/33.14 |
| 2,649,840 | 8/1953 | Davidson | 89/33.16 |
| 4,280,394 | 7/1981 | Singenberger et al. | 89/37.02 |
| 4,469,005 | 9/1984 | Schaulin et al. | 89/37.02 |

FOREIGN PATENT DOCUMENTS

| | | | |
|---|---|---|---|
| 329461 | 6/1918 | Fed. Rep. of Germany . | |
| 703943 | 2/1941 | Fed. Rep. of Germany . | |
| 2051355 | 4/1972 | Fed. Rep. of Germany | 89/33.02 |
| 23851 | 1/1922 | France | 89/37.02 |
| 589090 | 5/1925 | France . | |
| 971356 | 1/1951 | France . | |
| 982020 | 6/1951 | France . | |
| 1052733 | 1/1954 | France . | |
| 495187 | 11/1938 | United Kingdom | 89/33.14 |
| 548302 | 10/1942 | United Kingdom . | |
| 574673 | 11/1945 | United Kingdom . | |
| 574994 | 1/1946 | United Kingdom | 89/33.14 |
| 722226 | 1/1955 | United Kingdom | 89/33.5 |
| 1015309 | 12/1965 | United Kingdom . | |
| 1337388 | 11/1973 | United Kingdom . | |

OTHER PUBLICATIONS

Technical Journal Article, "Designing Gun Turrets as Integral Parts of Aircraft", Part III, published Jun., 1943, Aviation.

*Primary Examiner*—Stephen C. Bentley
*Attorney, Agent, or Firm*—Werner W. Kleeman

[57] ABSTRACT

A marine firing or weapon system containing a plurality of weapon barrels serves for combating rapidly flying targets in zenith and in azimuth or horizontal and possesses an inclined azimuth alignment axis. The ammunition infeed is accomplished from a number of stationary ammunition magazines arranged about a bent substantially vertical column. The ammunition magazines are located below the multi-barrel weapon system. Since the belted ammunition, due to the inclined azimuth axis, is guided along the aforementioned bent vertical column, which has a vertical extending portion at its lower section, a lengthwise compensation of the ammunition belts is needed during the rotation of the weapon system about the alignment azimuth axis. An elastic or flexible ammunition belt channel leads from each ammunition magazine to its related weapon barrel. These weapon barrels are cooled. Owing to the inclined azimuth alignment axis the minimum elevation or weapon depression is limited by an adjustable stop. Each ammunition magazine, constructed as a drum magazine, contains individual compartments each of which contains a loop of the ammunition or cartridge belt.

9 Claims, 29 Drawing Figures

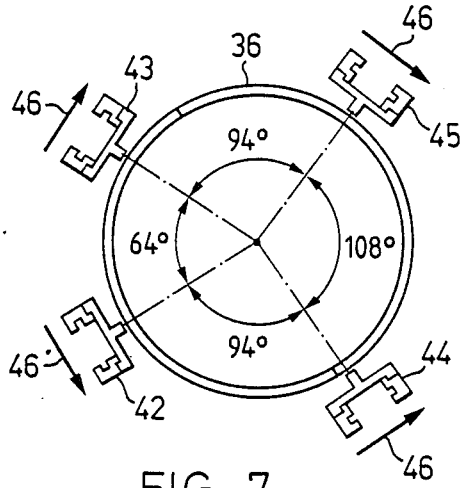
FIG. 7
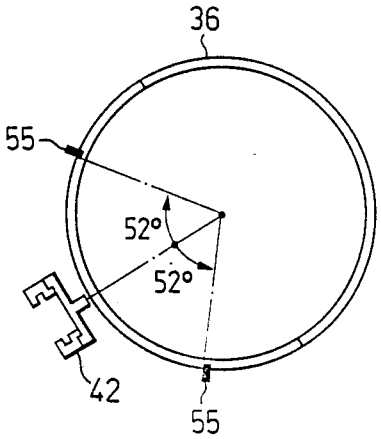
FIG. 8
FIG. 9
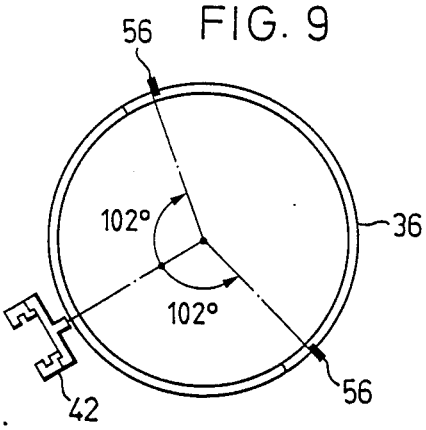
FIG. 10
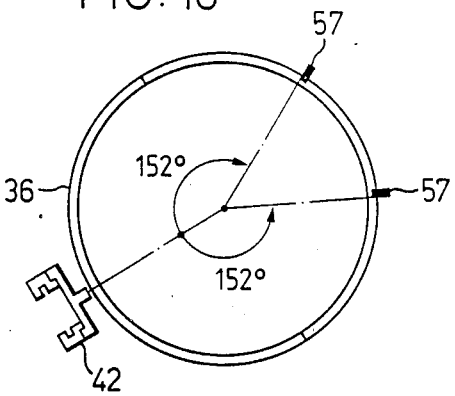

MARINE FIRING WEAPON FOR FIGHTING AIRBORNE TARGETS, ESPECIALLY IN ZENITH

CROSS REFERENCE TO RELATED APPLICATIONS

This application is a continuation-in-part of our commonly assigned, copending U.S. application Ser. No. 06/263,035, filed May 11, 1981, entitled "Marine Firing weapon for Fighting Airborne Targets, Especially in Zenith, now U.S. Pat. No. 4,469,005, granted Sept. 4, 1984.

This application is related to the commonly assigned copending U.S. application Ser. No. 956,221, filed Oct. 30, 1978, entitled "Marine Firing Weapon," now U.S. Pat. No. 4,280,394, granted July 28, 1981.

BACKGROUND OF THE INVENTION

The present invention broadly relates to weapon systems and, in particular, concerns a new and improved marine firing weapon or weapon system containing a plurality of weapon barrels for combating rapidly flying airborne targets located both in zenith and also in azimuth or horizontal.

Generally speaking, the multi-barrel marine weapon system for fighting airborne targets of the, present development is of the type containing an azimuthal alignment or aiming axis and an elevational alignment or aiming axis, there further being provided a device for the infeed of belted ammunition from a stationary ammunition magazine and containing a plurality of flexible ammunition channels leading from the ammunition magazine to the individual weapon barrels.

Weapon systems for combating airborne targets, especially in zenith are known to the art. Reference is specifically made to German Pat. No. 329,461, published Nov. 20, 1920, in which there has been disclosed a marine or naval weapon system which is mounted by means of a Cardan mounting arrangement which contains a device for eliminating the movements of the marine vessel. Furthermore, attention is directed to U.S. Pat. No. 2,978,961, granted April 11, 1961, where the azimuth axis and the elevation axis are arranged horizontally and at right angles to one another.

Reference is also particularly made to the French patent of addition No. 23,851, published Jan. 13, 1922, disclosing an armored vehicle upon which there is arranged an automatic firing weapon combined with a cannon. Additionally, the cannon is secured to a support enabling elevation of the cannon such that it can combat targets in zenith. According to FIG. 4 of this French patent the cannon can be moved about a horizontal elevation alignment axis and it can be pivoted about an inclined azimuth alignment axis. The patent does not disclose the manner of infeeding the ammunition.

Furthermore, in the aforementioned U.S. Pat. No. 4,280,394, granted July 28, 1981, there is described a marine firing weapon system having an inclined azimuth alignment axis as well as two relatively heavy drum magazines which are secured to the firing weapon. This undesirably appreciably increases the weight of the firing weapon. Aiming of the weapon system at rapidly moving targets, for instance rapidly flying aircraft, is rendered appreciably more difficult because of this additional weight, since appreciably larger forces are needed in order to accelerate the weapon system during the aiming thereof at the rapidly flying target. Additionally, with this known weapon system the azimuth alignment axis and the elevation alignment axis are arranged parallel to the surface of a wedge-shaped socket, so that the azimuth alignment axis is inclined in relation to the horizontal through an angle of about 20°.

In U.S. Pat. No. 2,483,334, granted Sept. 27, 1949, there is described a weapon system, wherein a cartridge infeed device contains a stationary ammunition magazine as well as an elastic belt channel. Here, however, the azimuth alignment axis is vertically arranged, so that there do not arise any problems during the infeed of the ammunition belts from the stationary ammunition magazine to the moveable firing weapon. This weapon system also is not capable of effectively combating airborne targets in zenith.

All of these heretofore known weapon systems are afflicted with the decisive drawback that there is rendered more difficult the infeed of the ammunition. Attempts have been made in order to avoid such drawbacks in that, either as previously explained, the drum magazine is itself arranged upon the moveable weaponry or weapon system, which, however, as also explained, requires larger forces for the acceleration of the weaponry during aiming thereof at a target, or the ammunition is arranged stationarily beneath the weapon system, whereby the azimuth alignment axis is vertically arranged and extends into the zenith. Hence, aiming in zenith is rendered more difficult or impossible, so that targets cannot be combated which are located in zenith.

Other exemplary embodiments of weapon systems have been disclosed by way of example, and not limitation, in U.S. Pat. Nos. 2,351,370, granted June 13, 1944; 2,479,633, granted Aug. 23, 1949; 2,483,385, granted Sept. 27, 1949; 2,538,045, granted Jan. 16, 1951; 2,582,225, granted Jan. 15, 1952; 2,483,334, granted Dec. 18, 1945 and 2,978,961, granted Dec. 15, 1953; British Pat. Nos. 548,302, granted Oct. 6, 1942; 583,410, granted June 6, 1946; 1,015,309, granted Dec. 31, 1965; 1,337,388, granted Nov. 14, 1973 and 574,673, granted Nov. 30, 1945; German Pat. Nos. 703,943, granted Mar. 19, 1941; 2,051,355, granted Oct. 20, 1970 and 329,461, granted Nov. 20, 1920; and French Pat. Nos. 589,090, granted May 22, 1925; 971,356, granted Jan. 15, 1951; 982,020, granted June 4, 1951; 1,052,733, granted Jan. 26, 1954 and 2,426,239, granted May 18, 1979.

SUMMARY OF THE INVENTION

Therefore, with the foregoing in mind it is a primary object of the present invention to provide a new and improved construction of weapon firing system for fighting airborne targets is not associated with the aforementioned drawbacks and limitations of the prior art heretofore discussed.

Another and more specific object of the present invention aims at overcoming the aforementioned drawbacks and providing a new and improved construction of marine firing weapon or weapon system which is suitable for fighting targets in zenith, and wherein there can be infed to the firing weapon belted ammunition from stationary drum magazines.

A still further noteworthy object of the present invention aims at providing a new and improved construction of marine firing weapon for fighting airborne targets, especially in zenith, which is relatively simple in construction and design, economical to manufacture, extremely reliable in operation, not readily subject to breakdown or malfunction, and requires a minimum of maintenance and servicing.

Yet another important object of the present invention is directed to the provision of a new and improved construction of marine firing weapon for fighting airborne targets, especially in zenith, wherein the belted ammunition is positively and reliably infed from each stationary ammunition magazine to the moveable weaponry or weapon system, and further wherein, in the event of large rolling and pitch movements of the vessel there is nonetheless afforded a reliable combating of targets in zenith.

Now in order to implement these and still further objects of the invention, which will become more readily apparent as the description proceeds, the inventive firing weapon system which contains a plurality of weapon barrels is manifested by the features that a stationary ammunition magazine is operatively associated with each weapon barrel. Leading from each stationary ammunition magazine to the related weapon barrel is a flexible or elastic belt channel. Furthermore, the weapon system contains an azimuth alignment or aiming axis which is inclined. The ammunition magazines are arranged about a central, bent, vertically oriented column or column member. Each belt channel is guided from its ammunition magazine along this vertically arranged column which is bent at its upper end. The bent portion of the column has a column axis which is arranged coaxially with respect to the azimuth alignment axis of the multi-barrel weapon system.

Furthermore, according to the invention, the azimuth alignment axis is inclined in relation to a vertical through an angle in the range of 20° to 45°, preferably at an angle of approximately 35°. In this way targets can be effectively combated in zenith notwithstanding the possibly encountered roll and pitch movements of the marine vessel at which the weapon system is mounted.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 7 is a sectional view, taken substantially along the line VII—VII of FIG. 6;

FIG. 8 is a sectional view, taken substantially along the line VIII—VIII of FIG. 6;

FIG. 9 is a sectional view, taken substantially along the line IX—IX of FIG. 6;

FIG. 10 is a sectional view, taken substantially along the line X—X of FIG. 6;

DETAILED DESCRIPTION OF THE PREFERRED EMBODIMENTS

Figure 1:
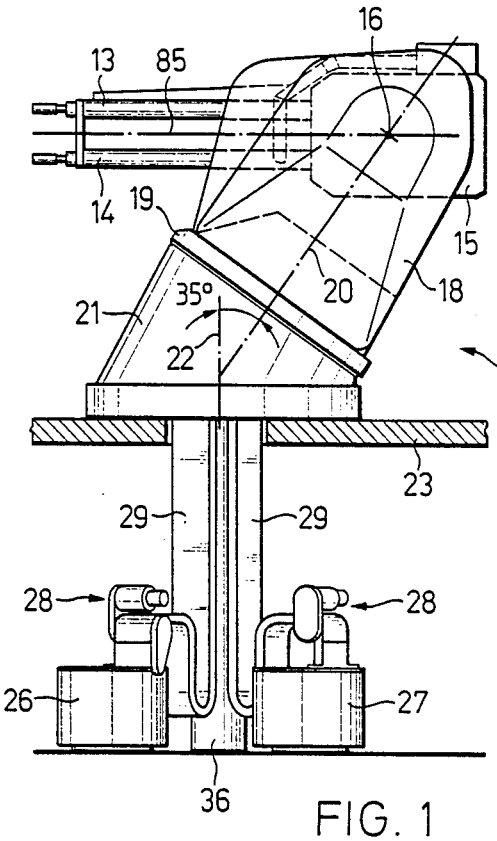
FIG. 1 is a side view of a marine firing weapon containing an ammunition magazine.
Figure 2:
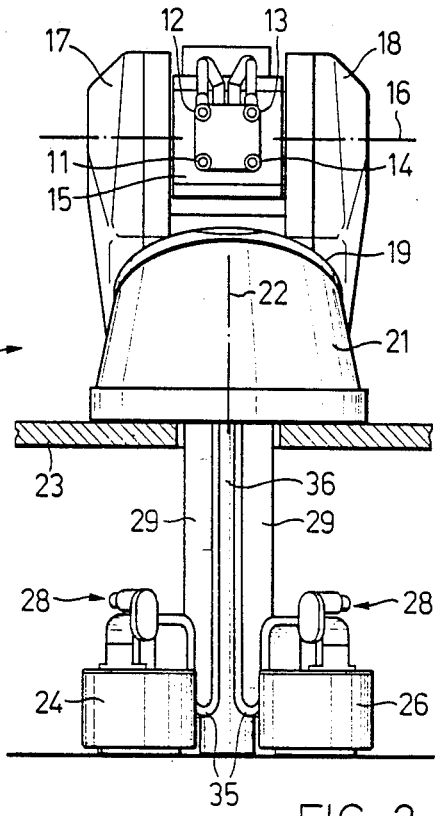
FIG. 2 is a front view of the marine firing weapon illustrated in FIG. 1.
Figure 3:
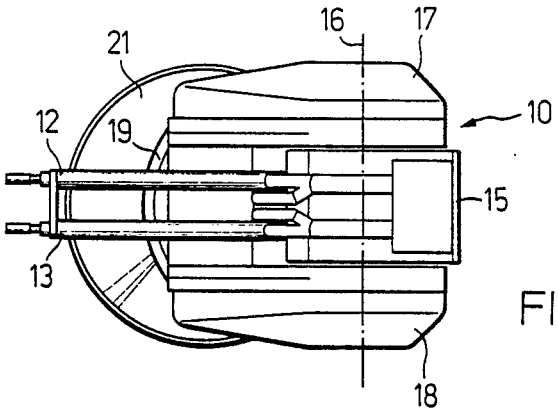
FIG. 3 is a top plan view of the marine firing weapon illustrated in FIG. 1.

Describing now the drawings, as will be seen by referring to FIG. 1 there is illustrated therein an exemplary embodiment of marine or naval firing weapon or firing weapon system containing a number of weapon barrels and serving for fighting airborne targets. In FIGS. 1, 2 and 3 it will be recognized that such multi-barrel marine firing weapon or weapon system 10 contains a plurality of weapon barrels, for instance, four weapon barrels 11, 12, 13 and 14 which are secured essentially in parallelism to one another upon a support or carrier 15. This support or carrier member 15 is pivotably mounted upon a support device 17, 18, 19 comprising two support members or arms 17 and 18 and a plate or disc 19. Upon this support device 17, 18, 19 the support or carrier 15 along with the four weapon barrels 11, 12, 13 and 14 are mounted for pivotable movement about a horizontal elevation axis 16.

Both of the support members or arms 17 and 18 are attached to the plate or disc 19 or equivalent structure which is rotatably mounted about an inclined azimuth alignment axis or aiming axis 20 upon a substantially wedge-shaped socket or pedestal 21. This socket 21 has an inclined surface upon which is pivotably mounted the plate 19 with the aid of a single bearing generally indicated by reference character 19*a*, and the azimuth alignment axis 20 is arranged substantia11y at right angles to the inclined surface of the wedge-shaped socket 21. The azimuth alignment axis 20 is inclined, in relation to a vertical axis 22, through an angle in a range of about 20° to 45°, preferably at an angle amounting to about 35°, as will be particularly well seen by referring to FIG. 1. The wedge-shaped socket or pedestal 21 is attached in any suitable manner to a marine vessel deck 23 of a not particularly here further shown marine or naval vessel.

The inclination of the azimuth alignment or aiming axis 20 in relation to the vertical axis 22 within the aforementioned range of about 20° to 45°, and preferably at an angle of about 35°, results from the following requirements: The azimuth alignment axis 20 should not extend into the zenith, so that the weapon barrels 11 to 14 which are aimed in zenith are not located parallel to the azimuth alignment axis 20 when they are directed at a target located in zenith. During aiming of the weapon system at the airborne target the angle between the weapon barrel axis and the azimuth alignment axis 20 should not be smaller than 7° to 10° since with smaller angles, as is known, aiming at the target becomes increasingly more difficult and finally becomes impossible. Furthermore, at a marine vessel the roll movements of the vessel can amount to ±30° and the pitch of the vessel can amount to ±15°, and such roll and pitch movements must be taken into account in the design of the weapon system. Hence, to ensure that during the possibly encountered roll and pitch movements of the marine vessel the azimuth alignment axis 20 does not extend into the zenith, it must be inclined in one direction through an angle greater than 30° to take into account the vessel's roll movements, and in the other direction through an angle greater than 15° to take into account the vessel's pitch movements. The azimuth alignment axis 20 lies in a range of about 20° to 45° in order to be able to take into account the roll and pitch movements of the marine vessel and in consideration of the position on the vessel where the firing weapon system is mounted. From the above considerations there results an inclination angle of the azimuth alignment axis 20 in the order of about 37° to 40° in relation to the vertical axis 22 in order to effectively take into account the possibly encountered rolling movements of the marine vessel which are greater than the pitch movements. For other reasons, as will be explained more fully hereinafter, there is chosen as the preferred angle an angle of about 35° between the azimuth alignment axis 20 and the vertical axis 22 in order to take into account the normally possibly attainable degree of flexing of the ammunition belt in its own plane.

Figure 4:
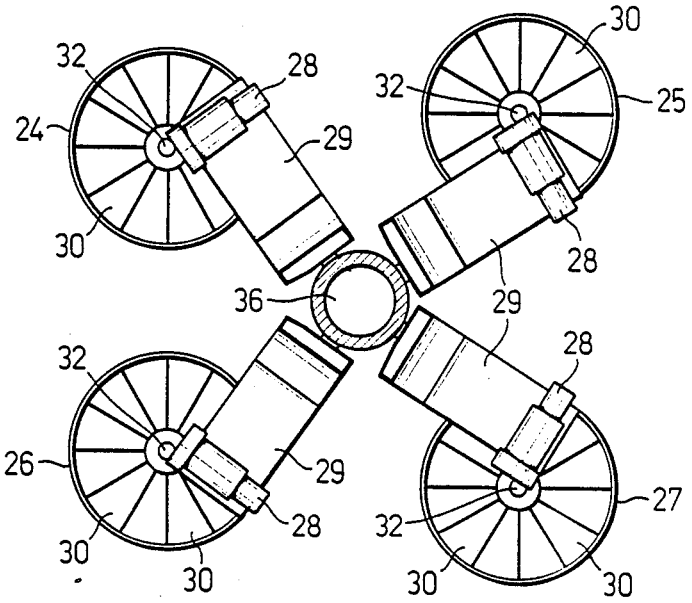
FIG. 4 is a top plan view of the ammunition magazines used in the arrangement of FIG. 1.

Below the deck 23 of the marine vessel or ship there are located four drum magazines 24, 25, 26 and 27, as has been particularly shown in FIG. 4. A respective belt channel 29 leads, with the aid of an auxiliary drive 28, from each drum magazine 24, 25, 26 and 27, to one of the four weapon barrels 11, 12, 13, and 14. The drum magazines 24, 25, 26 and 27 are stationarily arranged and neither participate in the rotational movement of the weapon about the azimuth axis nor in the elevational movement. The auxiliary drive 28 however cooperates with a suitable device 28*a* serving for the continuous rotation of the related drum magazine about its vertical axis or shaft 32 during the removal of the cartridge or ammunition belt 33 therefrom.

Figure 5:
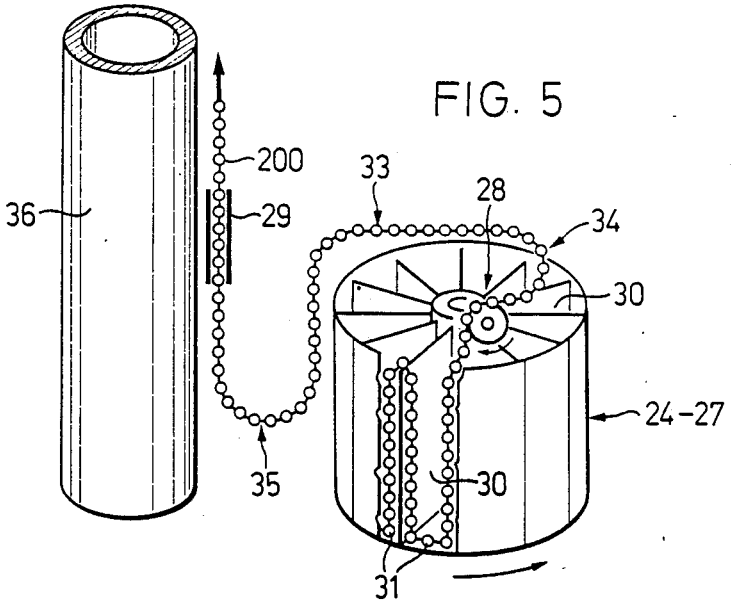
FIG. 5 schematically illustrates the infeed of the cartridge belt from the ammunition magazine to the firing weapon.

Each drum magazine 24, 25, 26 and 27 is subdivided into 12 sector-shaped compartments or sections 30, as particularly evident by referring to FIG. 5. In each compartment 30 there is located an ammunition belt loop 31 containing 21 cartridges, which have merely been schematically indicated in FIG. 5 by reference character 200. Therefore, each drum magazine 24, 25, 26 and 27 contains 252 cartridges, and in the four drum magazines 24, 25, 26 and 27 there are located therefore 1008 cartridges. Each such drum magazine 24, 25, 26 and 27 rotates about the vertical axis 32, and each sector-shaped magazine compartment 30 which is to be emptied is located exactly below the auxiliary drive 28. From the region of the auxiliary drive 28 the ammunition belt 33 moves through a deflection loop 34 and a lengthwise compensation loop 35 to a central column or column member 36. Adjacent such column member 36 the ammunition belt 33 is infed within the flexible or elastic belt channel 29 to the firing weapon.

Figure 6:
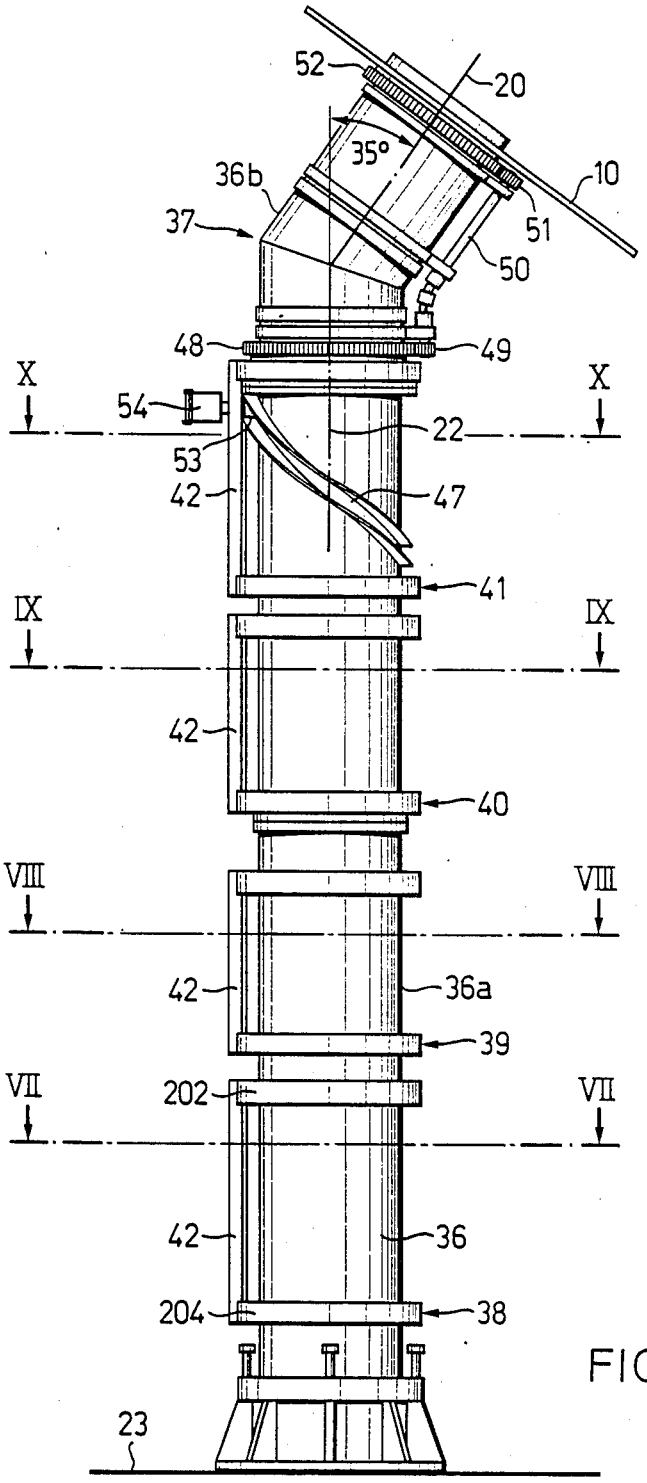
FIG. 6 is a view of a bent central column located below the firing weapon for the infeed of each cartridge belt.

The central column member 36 is provided at the region of its upper end with a bend or kink portion, generally indicated by reference character 37, as will be particularly evident by referring to FIG. 6. The lower portion 36*a* of the column therefore is substantially vertically dispositioned and the upper portion 36*b* of the bent column or column member 36 together with the weapon is inclined, in the embodiment under discussion, in relation to the vertical axis 22 through an angle of about 35°. The flexible belt channels 29, which are guided along both parts or portions 36*a* and 36*b* of the central column or column member 36, are bent at the region of the bend or kink portion 37, as particularly depicted in FIG. 11 in which, however, to simplify the illustration, there has only been depicted one belt channel 29. Depending upon which side of the central column 36 there is located the belt channel 29 it must be longer or shorter. It is for this reason that there must be provided the previously mentioned length compensation loops 35, so that during the rotation of the weapon system about the azimuth alignment axis 20 there can be compensated the length changes of the belt channels 29. Since the belt channels 29 are guided along the bent central column or column member 36, these belt channels 29 themselves, as mentioned previously, must be flexible. Since four belt channels 29 are simultaneously guided, in the exemplary illustrated embodiment, to the multi-barrel weapon system along the bent central column 36, there is required a flexibility of the belt channels 29 into mutually perpendicular planes. In the one plane, in which there are located the lengthwise axes of the cartridges, the flexibility of the belt channels 29 is however limited, and therefore the bend or kink 37 between both parts or portions 36*a* and 36*b* of the central column 36 must not exceed a predetermined value. It has been found that an optimum deflection of the flexible belt channels 29 can be obtained at an angle of about 35°. It is for this reason that a preferred inclination of the azimuth alignment axis 20 with respect to the vertical axis 22 is in the order of about 35°.

By virtue of the described inclination of the azimuth alignment axis 20 the weapon barrels 11, 12, 13 and 14 can be elevated about the elevation alignment axis 16 past the zenith, without the weapon barrel axes having to be aligned parallel to the azimuth axis. The target determination and target tracking in zenith and at the region of the zenith therefore is appreciably simpler than with vertical azimuth axis.

As will be seen from the illustration of FIG. 6 at the central column member 36 there are rotatably arranged four cages or cage members 38, 39, 40 and 41. Each of these cages 38, 39, 40 and 41 possesses four rail members 42, 43, 44 and 45, which have been shown in FIG. 7 in cross-sectional view and serve for guiding the belt channels 29 (FIG. 1). The cages 38, 39, 40 and 41 are secured against axial displacement at the column member 36. The position of the cartridges guided in the belt channels 29 is indicated by four arrows 46. In FIG. 6 there has been illustrated in each instance only the one rail or rail member 42 of each of the cages 38, 39, 40 and 41. Each cage 38, 39, 40 and 41 consists of an upper ring or ring member 202 and a lower ring or ring member 204. These ring members 202, 204 are held together by the four rails 42, 43, 44 and 45.

As will be apparent from the illustration of FIG. 7, the four rails 42, 43, 44 and 45 are not uniformly distributed about the circumference of the central column member or column 36.

By again reverting to FIG. 6 it will be understood that four substantially helical-shaped rail members or rails 47 are rotatably mounted internally of the uppermost cage member 41 upon the column member 36. Only one of such rail members 47 has been however illustrated. These four rail members 47 are fastened to a gear 48 which is rotatable but mounted so as not to be axially displaceable upon the vertical part or portion 36*a* of the column member 36. The gear 48 meshes with a pinion 49 which is secured to a Cardan shaft 50. At the upper end of the Cardan or universal shaft 50 there is secured a second pinion 51 which meshes with a second gear 52. This second gear 52 is attached at the firing weapon 10 and rotates when the firing weapon 10 is pivoted or rotated about the azimuth axis or azimuth alignment axis 20. During rotation of the weapon 10 about the azimuth alignment axis 20 the gear along with the four helical-shaped rail members 47 are rotated about the column member 36 by the action of the gear 52, pinion 51, Cardan shaft 50 and pinion 49. Guided within each helical-shaped rail or rail member 47 is a roller or roll 53 which is fastened at a holder 54. Secured at this holder or holder member 54 are the four belt channels 29 illustrated in FIGS. 1 and 2. The holders 54 are guided to be displaceable in the rail or rail members 42, 43, 44 and 45 and during the described rotation of the rails 47, these holders 54 are displaced in axial direction upon the central column member 36. Due to this displacement of the holders or holder members 54 the ammunition belt channels 29 are raised and lowered, which is possible by virtue of the provision of the lengthwise compensation loops 35 (FIGS. 1, 2 and 5). This raising and lowering of the ammunition belt channels 29 is necessary since, as will be recalled, the column member 36 possesses a bend or bent portion 37.

According to the illustration of FIG. 8, the lowermost cage member 38 is limited as concerns its rotational movement about the column member 36 by two stops or impact members 55. These stops 55 allow a rotation of the lowermost cage or cage member 38 along with the four rails 42, 43, 44 and 45 from the starting position in both directions of rotation, in each case through an angle of 52°.

As will be seen from FIGS. 9 and 10 also the second and third cages 39 and 40, respectively, are limited in the same manner as was the case for the first cage 38, by the stops or impact members 56 and 57, respectively, in their rotational movement about the column member 36. However, the stops 56 allow for a rotation of the second cage 39 having the four rails 42, 43, 44 and 45, out of the starting position in each case through 102° in both directional senses, and the stops or impact members 55 allow for a rotation of the third cage 40 containing the four rails 42, 43, 44 and 45 in both directions of rotation, starting from the starting position, in each case through 152°. This different arrangement of the stops or impact members 55, 56 and 57 ensures that during the rotation of the firing weapon 10 out of its starting position, in both directions of rotation, in each case through 200°, the ammunition belt channels 29 will wind in an essentially uniform helical or screw line about the column member 36. During such winding of the belt channels 29 about the column member 36 the helical or screw-shaped rails 47 raise and lower, as the case may be, the ammunition belt channels 29, in order to ensure for the lengthwise compensation of the belt channels 29 which is needed because of the bend location or bent portion 37 of the column member 36.

Figure 11:
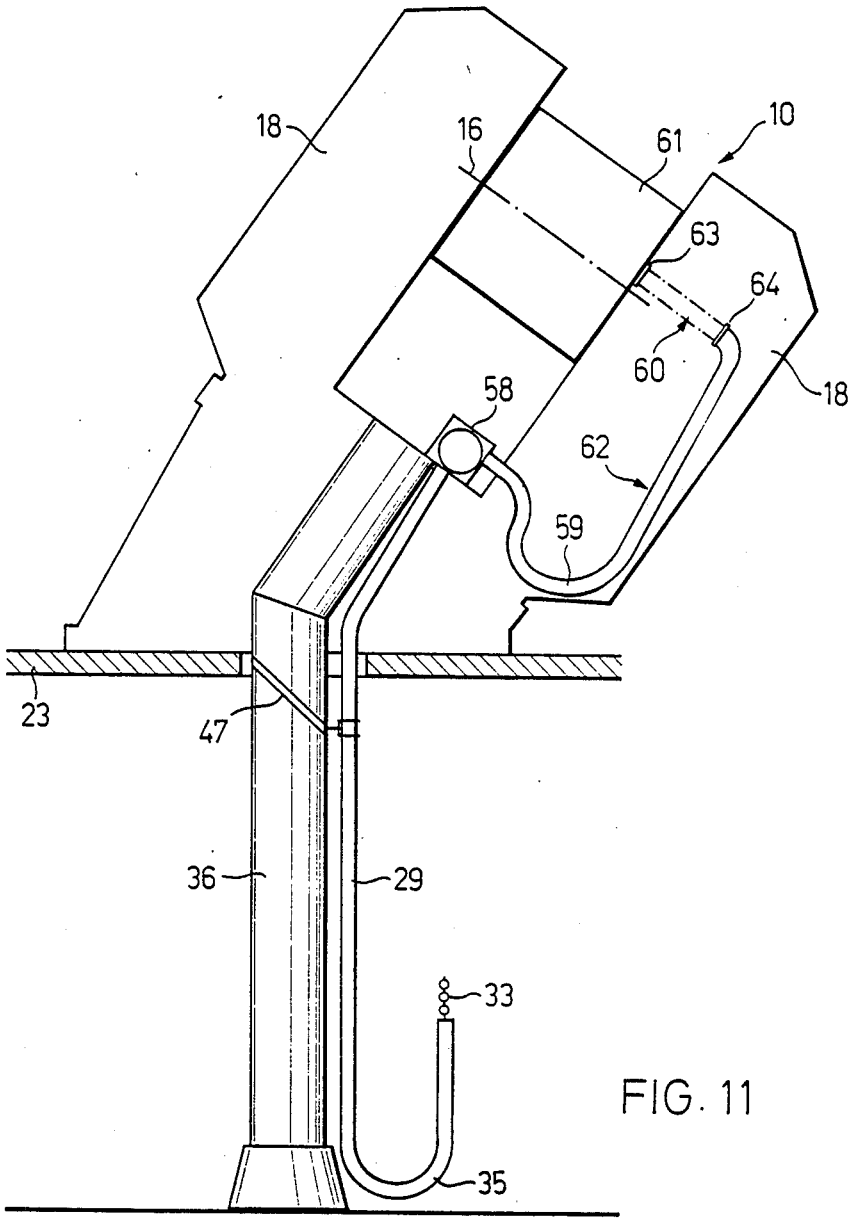
FIG. 11 is a schematic illustration of the cartridge infeed from the ammunition magazine to the firing weapon.

As will be recognized by referring to FIG. 11 the cartridge belt 33 which is guided in the belt channel 29 along the central column member 36 through the opening in the ship's deck 23 to the firing weapon 10, arrives at a second auxiliary drive or drive means 58 and from that location is fed by means of a second lengthwise compensation loop 59 to a belt channel portion of section 60, which is directed at right angles to the firing weapon, here indicated by reference character 61, of which in FIG. 11 there has only been illustrated a rectangular cross-section. This ammunition belt channel section 60 is of elastic design and is loaded in pure torsion during the elevation of the weapon 61 about the elevation axis 16. So that the belt channel section or portion 60 can be constructed to be as short as possible, only a portion of the elevation causes a torsion of the belt channel section 60, the remaining portion of the elevation causes a curvature of the neighboring belt channel section or portion 62.

This belt channel section, which will be conveniently designated hereinafter as the elastic belt channel 60, contains, according to the illustration of FIGS. 12, 13 and 14, two identical or essentially similar end or terminal elements 63 and 64. As shown in FIG. 11 the one terminal or end element 63 is fastened to the firing weapon 61 and completely participates in the elevation movement. The other end or terminal element 64, likewise as shown in FIG. 11, is rotatably mounted in the support member 18 of the firing weapon and only partially participates in the elevation movement. Both of these end elements 63 and 64 of the elastic belt channel 60 are always parallel to one another and the part of the elastic belt channel 60 which is located between both of the end elements 63 and 64 is loaded purely in torsion. This part of the belt channel 60 located between both of the end or terminal elements 63 and 64 consists of a number of intermediate elements 65.

Figure 13:
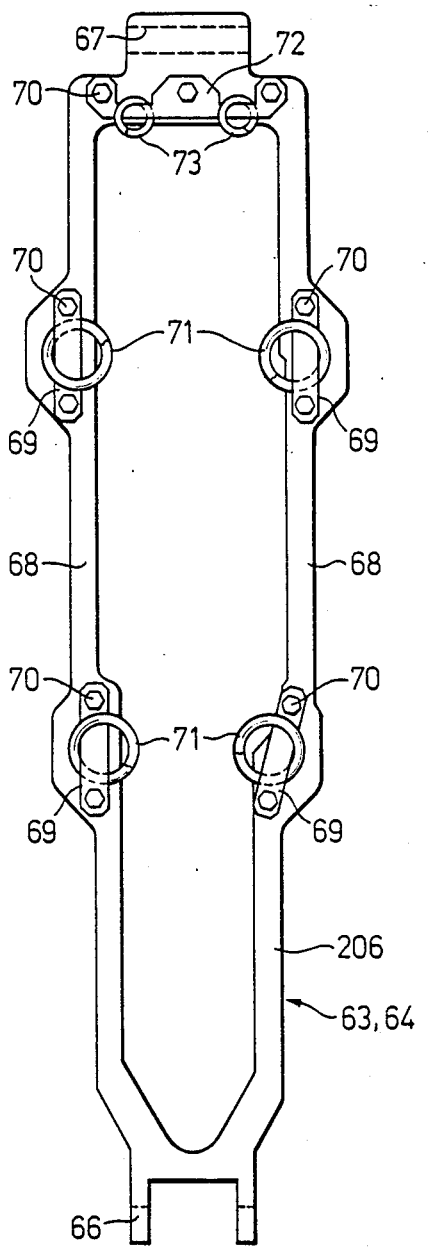
FIG. 13 is a view of an element of the elastic belt channel shown in FIG. 12.

As will be seen by reverting to FIG. 13 both of the end elements 63 and 64 each consist of a rigid frame, generally indicated by reference character 206, which completely enclose the cartridges. This rigid frame 206 possesses, on the one hand, at both ends bores or apertures 66 and 67, by means of which the frame 206 can be attached at the firing weapon 61 and at the support member 18 and, on the other hand, such frame 206 possesses at both lengthwise legs 68 two respective brackets or bracket members 69 which are secured by means of threaded bolts or screws 70 or equivalent structure at the lengthwise legs or leg members 68. These brackets 69 serve for fixedly clamping helical springs 71 which extend over the entire length of the belt channel 60. The ends of these helical springs 71 are secured at one end at the left end element 63 and at the other end at the right end element 64. At an end face or side of the end or terminal elements 63 and 64 there are attached by means of the brackets 72 two further helical springs 73 which likewise extend over the entire length of the elastic belt channel 60 and the ends of which are attached, on the one hand, at the left end element 63 and, on the other hand, at the right end element 64.

Figure 14:
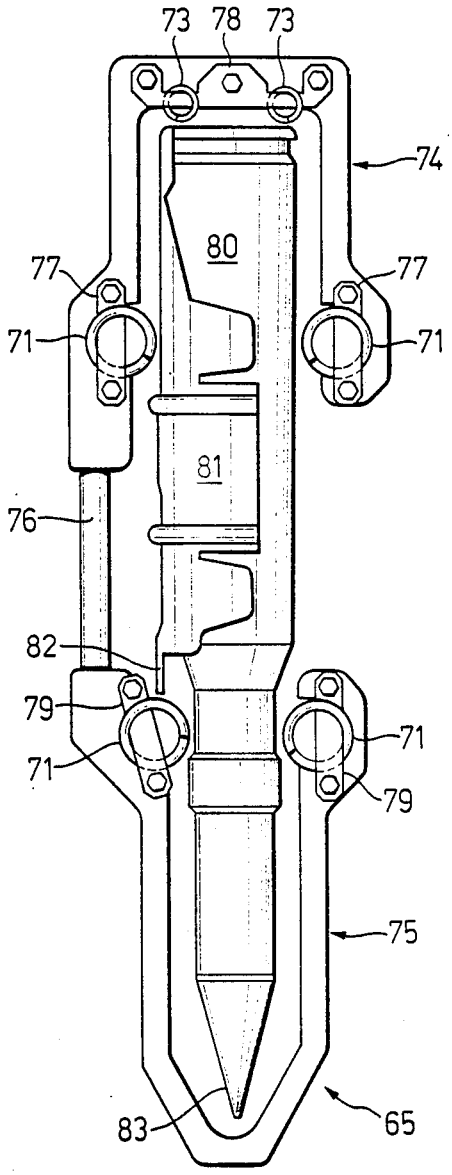
FIG. 14 is a view of an intermediate element of the elastic belt channel of FIG. 12.

In contrast thereto the intermediate elements of the arrangement of FIG. 14 are formed of two frame portions 74 and 75 which are pivotably connected with one another by a rod 76. At the upper frame portion 74 there are secured by means of three brackets or bracket members 77 and 78 both of the helical springs 71 and the further helical springs 73. At the lower frame portion or part 75 there are attached, likewise by means of two brackets 79, the helical springs 71. As will be further apparent from the showing of FIG. 14, each cartridge 80 is laterally guided by four helical or coil springs 71 or equivalent structure and bears by means of its cartridge sleeve base at the helical springs 73. Additionally, the cartridges 80 are retained in belt elements or links 81. These belt elements 81 each possess a nose member 82 which likewise bears upon one of the helical springs 71. In this way there is prevented that the cartridge tip 83 will come into contact with the lower frame portion of part 75. These intermediate elements 65 are secured at the same spacing from one another at the helical springs 71 and 73. The shaft 76 or the like arranged between both of the frame portions 74 and 75 ensures for a rotation of these frame portions 74 and 75 towards one another when the elastic belt channel 60 is loaded in torsion.

Figure 15:
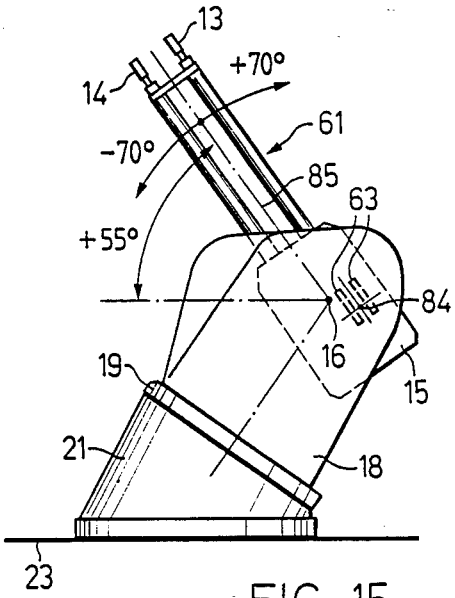
FIG. 15 is a side view of the marine firing weapon at an elevation of 55° and in cross-section through the elastic belt channel.

As will be understood by referring to FIG. 15 the firing weapon 61 can be elevated out of an intermediate or mean elevation of 55° downwardly through 70° and upwardly through 70°. In FIG. 15 there have been shown, apart from the firing weapon 61, also the ship's deck 23 containing the socket or pedestal 21 and the disc 19, at which there is secured the support member 18. The firing weapon 61 is pivotable about the elevation axis 16. Furthermore, there have been schematically illustrated in FIG. 15 both of the end elements 63 of two elastic ammunition belt channels 60 (FIG. 12), which are arranged above and below a torsion axis 84 which, for constructional reasons is offset in relation to the elevation axis 16. Through the lower end element 63 cartridges 80 arrive at the lower weapon barrel 14 and through the upper end or terminal element 63 cartridges 80 arrive at the upper weapon barrel 13. Both of these end elements 63 are attached at the firing weapon 61, and thus, participate in the elevation movement of the firing weapon 61, i.e. they are always parallel to the weapon axis 85.

Figure 12:
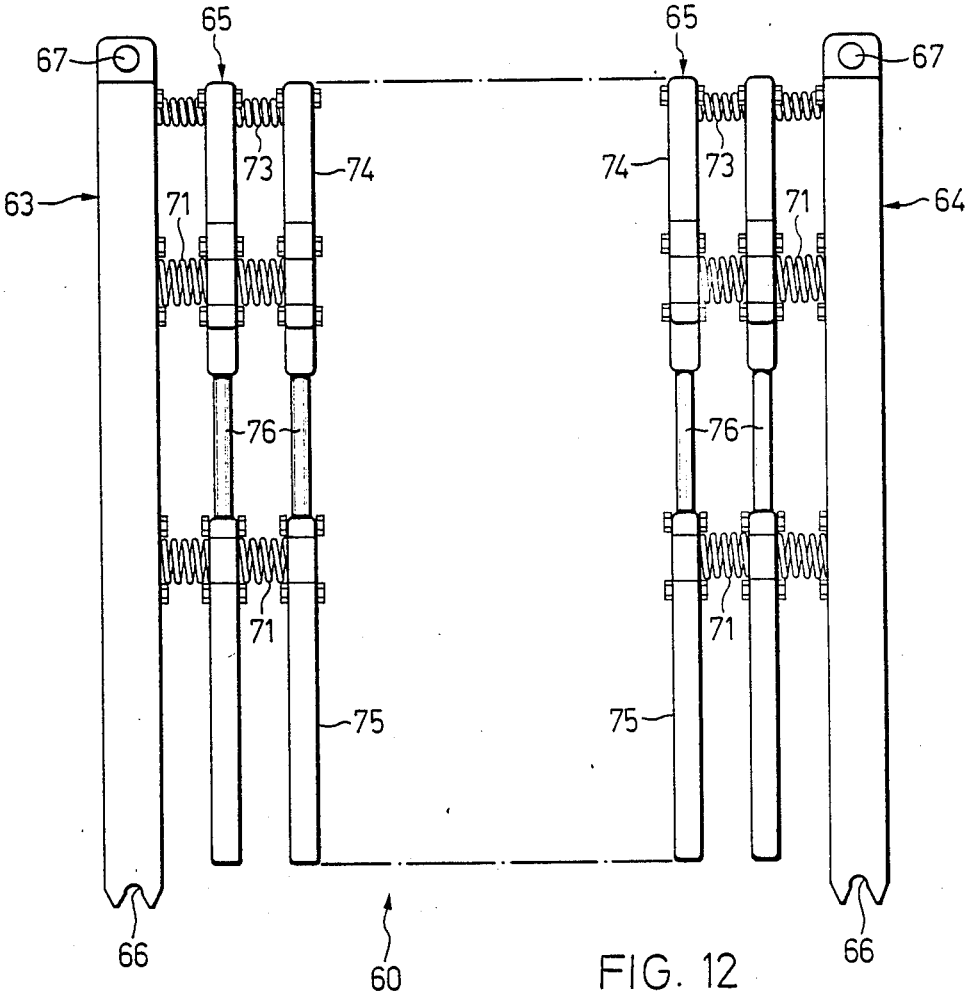
FIG. 12 illustrates details of an elastic ammunition belt channel.
Figure 16:
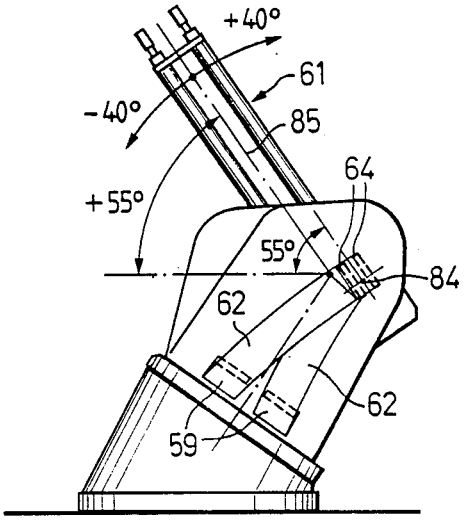
FIG. 16 is a view, analogous to the showing of FIG. 15, but illustrating a different cross-section through the elastic ammunition belt channel.

FIG. 16 illustrates both of the other end or terminal elements 64 of the elastic belt channel 60 (FIG. 12). At such end elements 64 there are secured the neighboring belt channels 62 (FIG. 11). Moreover, in FIG. 16 there have been illustrated the same parts as in FIG. 15. According to the showing of FIG. 16 the end elements 64 likewise are shown parallel to the weapon axis 85, exactly as was the case for the other end elements 63 in the illustration of FIG. 15. The elastic belt channel 60 is therefore not loaded in torsion in the intermediate elevation of 55° of the firing weapon 61. As will be recognized by reverting to FIG. 16, the weapon can be elevated upwardly and downwardly in each case through a respective elevation angle of 40°, without the end element 64 of the elastic belt channel 60 having to pivot.

Figure 17:
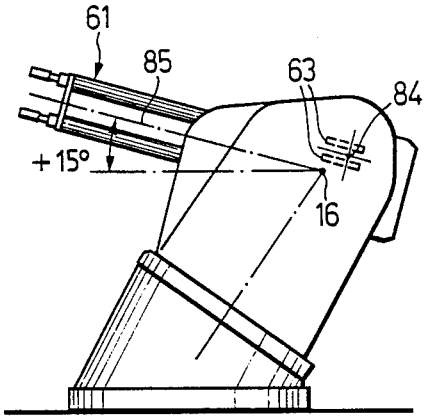
FIG. 17 is a side view of the marine firing weapon at an elevation of 15° showing a first cross-section through the elastic ammunition belt channel.
Figure 18:
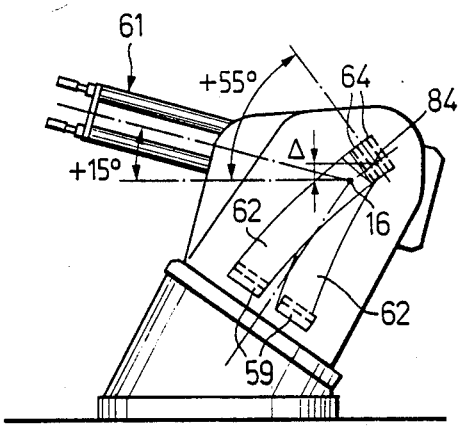
FIG. 18 is a view, like the showing of FIG. 17, but illustrating a second cross-section through the elastic ammunition belt channel.

In the showing of FIGS. 17 and 18 the firing weapon 61 has been downwardly elevated through −40° out of its intermediate elevation of 55°. The end elements 63 of the elastic ammunition belt channel 60 (FIG. 12), according to the showing of FIG. 15, are inclined by +15° in relation to the horizontal and, according to the showing of FIG. 18, the other end elements 64 of the elastic belt channel 60 are inclined without change through 55° in relation to the horizontal. Therefore, the elastic belt channel 60, in the counterclockwise direction, is loaded in torsion through 40°. According to FIG. 18 the axis 84, during such elevation of the weapon through -40° , is pivoted about the elevation axis 16 and now is located higher than the elevation axis 16 by the amount Δ. The neighboring belt channel 62 is thus raised and the loop 59 is reduced in size.

Figure 19:
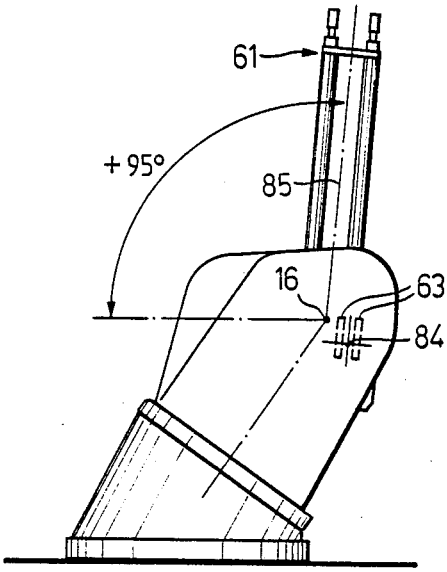
FIG. 19 is a side view of the marine firing weapon at an elevation of 95°, illustrating a first cross-section through the elastic ammunition belt channel.
Figure 20:
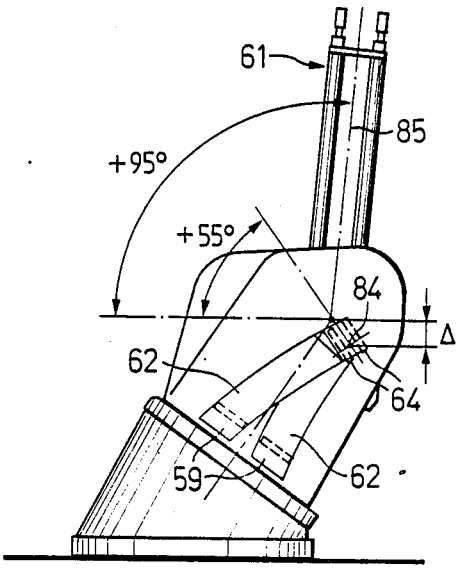
FIG. 20 is a view, analogous to the showing of FIG. 19, but illustrating a second cross-section through the elastic ammunition belt channel.

As will be seen from FIGS. 19 and 20 the firing weapon 61 has been elevated upwardly out of its intermediate elevation of 55° through +40°. The end or terminal elements 63 of the elastic belt channel 60 (FIG. 12) are now inclined, as shown in FIG. 19, through 95° in relation to the horizontal, and according to FIG. 20 the other end elements 64 of the elastic belt channel are inclined without change through 55° in relation to the horizontal. Hence, the elastic belt channel 60 is loaded in clockwise direction at a torsion of 40°. According to FIG. 20 the axis 84, during this elevation of the weapon, has been pivoted through +40° about the elevation axis 16 and now is located by an amount Δ lower than the elevation axis 16. The neighboring belt channel 62 is thus lowered and the loop 59 is enlarged.

Figure 21:
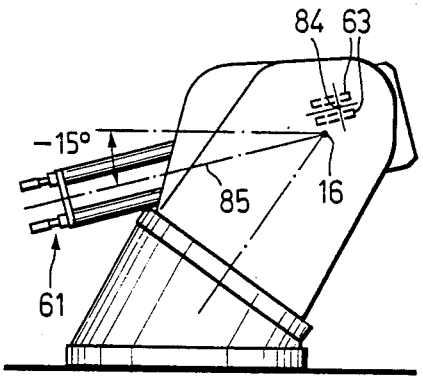
FIG. 21 is a side view of the marine firing weapon having the smallest possible elevation of −15° and portraying a first cross-section through the elastic ammunition belt channel.
Figure 22:
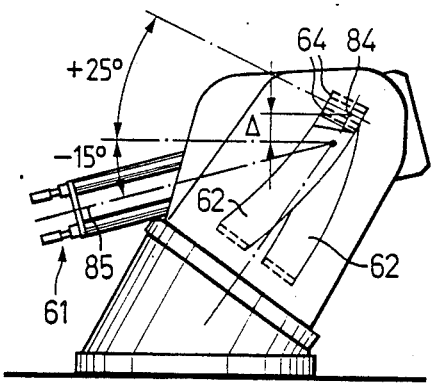
FIG. 22 is an illustration analogous to the showing of FIG. 21, but portraying a second cross-section through the elastic ammunition belt channel.

According to the showing of FIGS. 21 and 22 the firing weapon 61 has been downwardly elevated through −70° out of its intermediate elevation of 55°. The end or terminal elements 63 of the elastic belt channel 60 (FIG. 12), as shown in FIG. 21, are inclined through −15° in relation to the horizontal, and according to the showing of FIG. 22 the other end elements 64 of the elastic belt channel 60 are likewise pivoted through −30° and, thus, inclined through +25° in relation to the horizontal. The elastic ammunition belt channel 60 is loaded, in counterclockwise direction, at a torsion of 40°. According to FIG. 22 the axis 84, during this elevation of the weapon, has been pivoted about the elevation axis 16 and now is located by the amount Δ at a higher position than the elevation axis 16. The neighboring belt channel 62 has therefore been raised and the loop 59 reduced in size.

Figure 23:
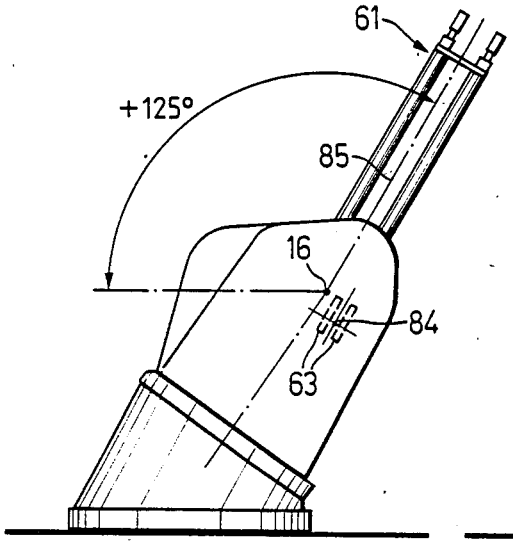
FIG. 23 is a side view of the marine firing weapon with the greatest possible elevation of 125° and illustrating a first cross-section through the elastic ammunition belt channel.
Figure 24:
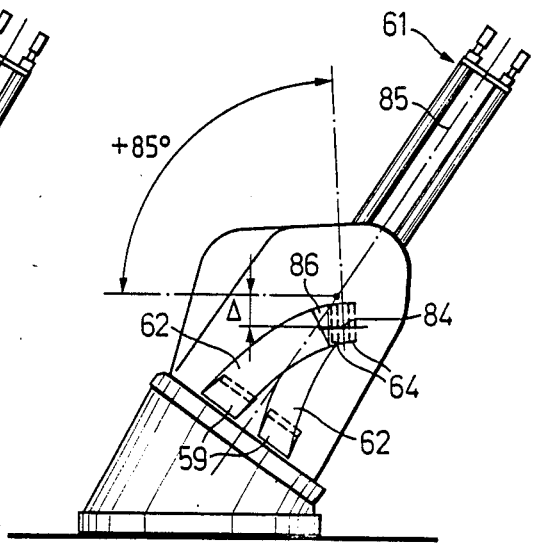
FIG. 24 is a showing analogous to that of FIG. 23, but portraying a second cross-section through the elastic ammunition belt channel.

As will be seen from FIGS. 23 and 24 the firing weapon 61 has been elevated upwardly through +70° out of its intermediate or mean elevation of +55°. The end elements 63 of the elastic ammunition belt channel 60 (FIG. 12), according to the showing of FIG. 23, are inclined through 125° in relation to the horizontal, and according to FIG. 24 the other end elements 64 of the elastic belt channel 60 likewise have been pivoted through +30° and therefore are inclined in relation to the horizontal by +85°. The elastic belt channel 60 is loaded in clockwise direction at a torsion of 40°. According to FIG. 24 the axis 84, during this elevational movement of the weapon 61, has been pivoted about the elevation axis 16 and now is located by the amount Δ in a lower position than the elevation axis 16. The neighboring belt channel 62 has thus been lowered and the loop 59 enlarged in size.

To avoid any too pronounced curvature of the neighboring belt channel 62, when the weapon is elevated through +125° according to FIG. 24, there is beneficially arranged a fixed wedge-shaped belt channel piece or element 86 at the upper end of the belt channel 62 and forwardly of the end element 64 of the belt channel 60.

Figure 26:
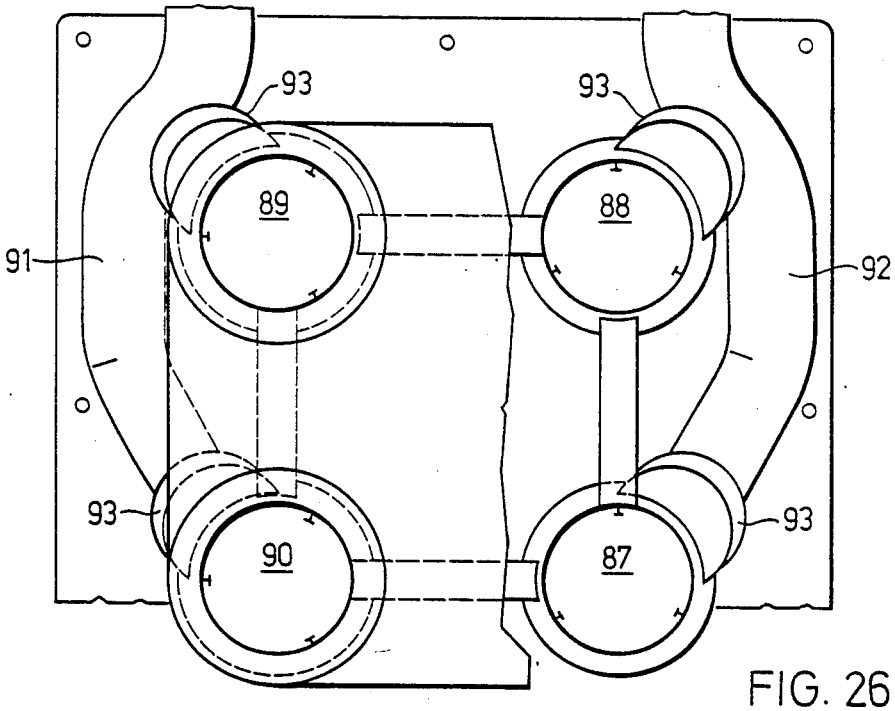
FIG. 26 is a cross-sectional view of the arrangement of FIG. 25, taken substantially along the section line XXVI—XXVI thereof.
Figure 25:
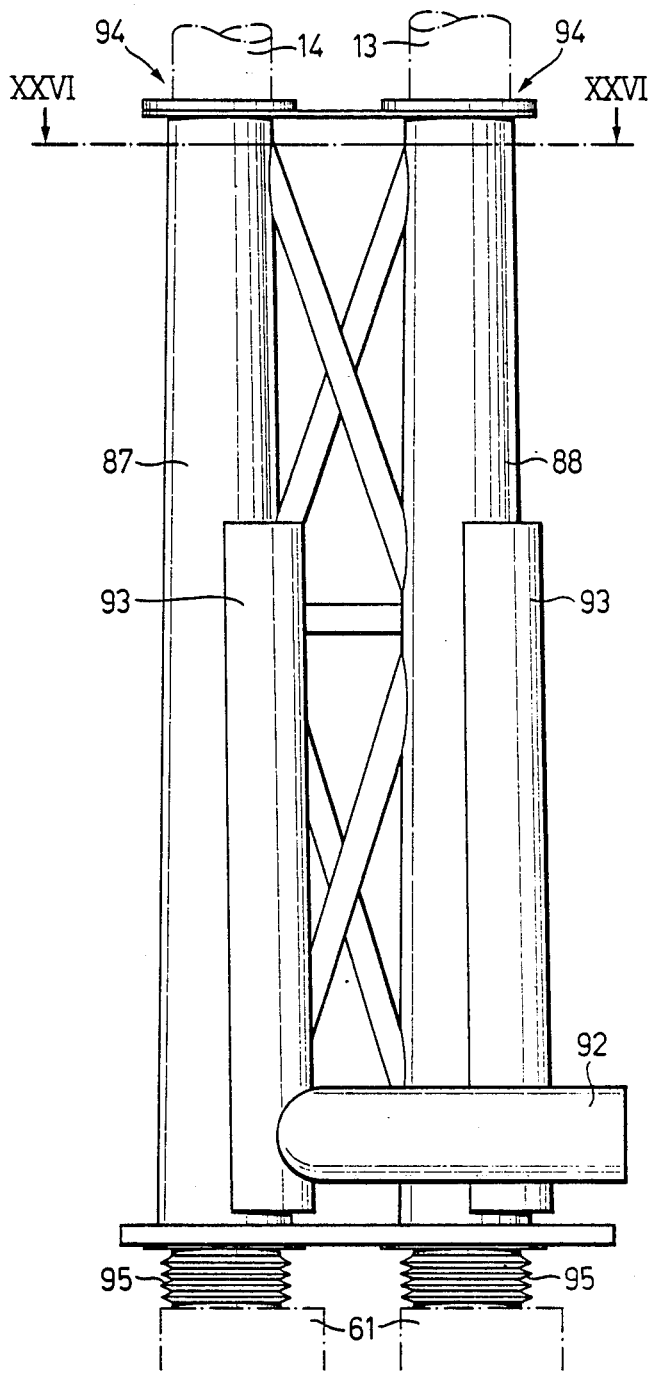
FIG. 25 is a view of a device for cooling the weapon barrels.

As will be seen by inspecting FIGS. 2, 25 and 26 there are arranged about the weapon barrels 11, 12, 13 and 14 cooling tubes or pipes 87, 88 and 89 and 90 which, on the one hand, contribute to reinforcement of the weapon barrels 11, 12, 13 and 14 and, on the other hand, ensure for a uniform cooling at all sides and throughout the entire circumference of the weapon barrels 11, 12, 13 and 14. The cooling medium, here cooling air, is infed by any suitable and therefore not particularly illustrated ventilator or fan by means of two pipes or tubes 91 and 92 from above or from below to the weapon barrels 11, 12, 13 and 14. So that the cooling air can arrive without great resistance out of the tubes 91 and 92 into the cooling tubes 87, 88, 89 and 90 there are attached cylindrical widened or enlarged portions 93 at the cooling tubes or pipes 87, 88, 89 and 90. The cooling air can escape again into the atmosphere at the front end 94 of the cooling pipes or tubes 87, 88, 89 and 90 by not particularly illustrated check or non-return valves or equivalent structure. The cooling tubes 87, 88, 89 and 90 are not arranged so as to be recoil movable. At the rear end of each cooling tube 87, 88, 89 and 90 there thus is attached one end of a bellows 95, the other end of which is secured to the weapon 61. The weapon 61 therefore can be shifted in relation to the cooling tubes 87, 88, 89 and 90, without cooling air escaping rearwardly out of the cooling tubes 87, 88, 89 and 90.

As will be particularly evident by reverting to FIG. 1, the elevation of the firing weapon, such as a cannon, also is dependent upon azimuth, i.e. upon the pivot movements about the azimuth axis or azimuth alignment axis 20. If, for instance, the weapon is pivoted out of the position of FIG. 1 through 180° about the azimuth axis or azimuth alignment axis 20, then the elevation reduces from −15° to −85°. The weapon then would be directed towards the ship's deck 23 or against superstructure mounted at the ship or vessel, something obviously intolerable. Therefore, there is required a stop or impact means which limits the elevation in downward direction. Such stop must be adjustable as a function of the azimuth angle.

Figure 27:
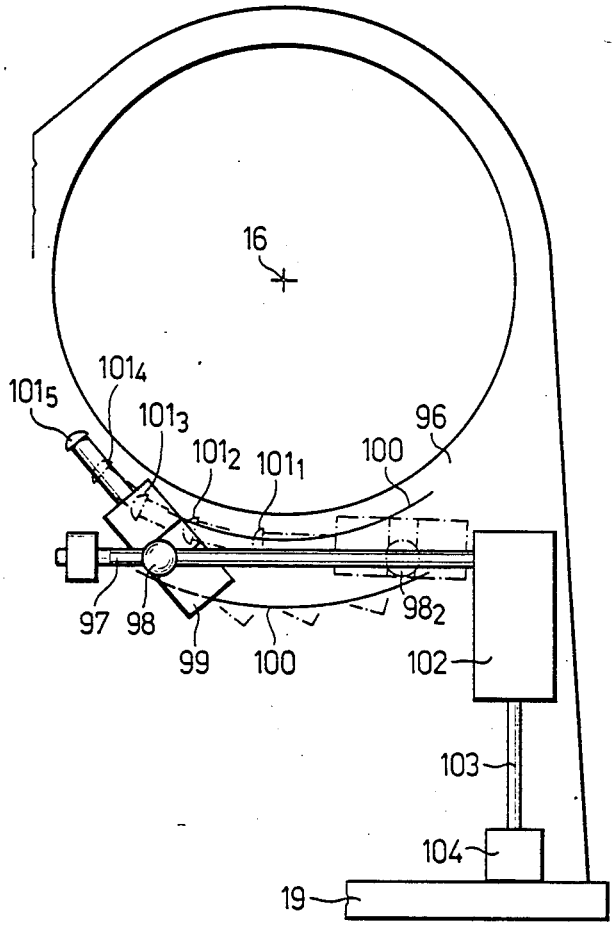
FIG. 27 is a schematic view of a device for controlling a displaceable stop or impact member for the minimum elevation.
Figure 28:
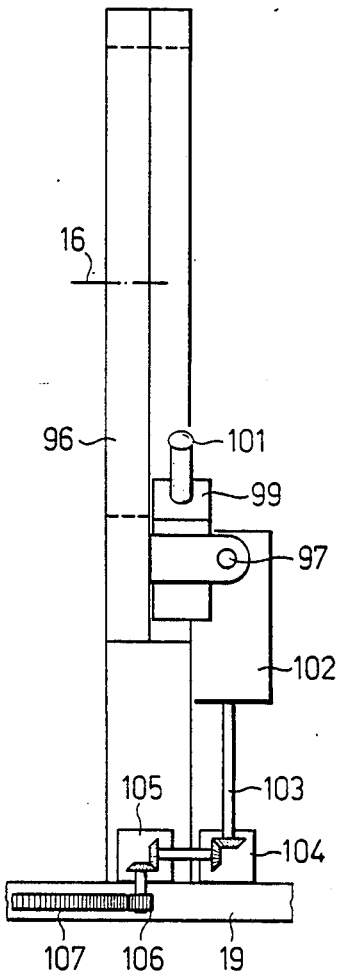
FIG. 28 is a side view of the device illustrated in FIG. 27.

As will be seen from FIGS. 27 and 28 the not particularly here illustrated weapon is mounted to be elevational about the elevation axis 16 in a bearing or support ring 96. At this bearing ring 96 there is rotatably mounted in tangential location a threaded spindle 97. Located upon this threaded spindle 97 or equivalent structure is a spherical-shaped nut member 98 which can be displaced by rotating the threaded spindle 97. The spherical-shaped nut or nut member 98 is located in a housing 99 which is guided concentrically with respect to the elevation axis 16 upon an arcuate-shaped path or track 100. Secured to this housing 99 is a stop or impact member 101 which limits in downward direction the elevation of the firing weapon. This stop 101, which moves along a circular arc, cooperates with an appropriate here not further shown stop or impact member provided at the firing weapon. In FIG. 27 there has been designated by reference character $\mathbf{101}_1$ the lowermost position of the stop or impact member and the uppermost position of such stop has been designated by reference character $\mathbf{101}_5$. Additionally, there have been illustrated the three intermediate positions $\mathbf{101}_2$, $\mathbf{101}_3$ and $\mathbf{101}_4$. The threaded spindle 97 is drivingly connected by means of a gearing 102 with a shaft 103. The shaft 103 is connected in driving relationship by means of further gears 104 and 105 (FIG. 28) with a pinion 106. This pinion 106 meshes with a toothed rim or ring gear 107 or equivalent structure which is attached at the firing weapon and which is located in the disc 19 (FIG. 1) and participates in the rotation of the weapon about the azimuth axis or azimuth alignment axis 20 (FIG. 1).

The weapon can be pivoted out of the starting position of FIG. 1 in clockwise direction and also in counterclockwise direction about the azimuth axis or azimuth alignment axis 20 in each case through 180°. During this pivoting of the firing weapon in the one or the other directional sense it is necessary to displace the stop or impact member 101 out of the position $\mathbf{101}_1$ into the position $\mathbf{101}_5$, by means of the toothed rim 107, pinion 106, the gearing or gear means 105 and 104, the shaft 103, the gearing 102 and the threaded spindle 97. Hence, in the gearing or transmission arrangement 102 there is provided a switching device so that the threaded spindle 97 always rotates in the same sense, independent of whether the firing weapon and thus the toothed rim or ring gear 107 has been rotated in the clockwise direction or in the counterclockwise direction. Such reversal gearing is well known in the art and therefore need not here be further discussed, particularly since details thereof do not constitute subject matter of the present invention.

Figure 29:
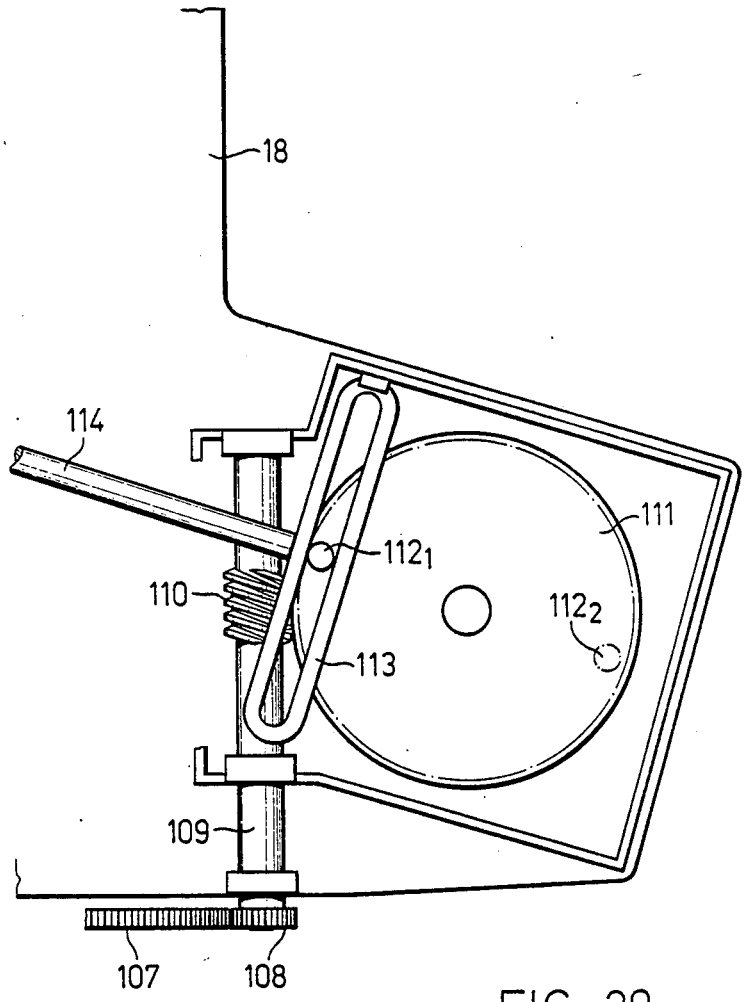
FIG. 29 illustrates a different embodiment of control device from that shown in FIG. 27.

FIG. 29 illustrates a further embodiment for the displacement of the stop or impact member 101 (FIG. 27), wherein here there is not required the aforementioned reversal or switching device.

According to the showing of FIG. 29 the toothed rim or ring gear 107 which is attached at the firing weapon 10, during the pivoting of such firing weapon 10 about the azimuth axis or azimuth alignment axis 20 (FIG. 1), drives a pinion 108. This driven pinion 108 is attached at a shaft 109. Seated upon the shaft 109 is a worm 110 which engages with a worm gear 111. This worm gear 111 possesses an eccentrically mounted pin 112 which is guided in a rail member 113 or equivalent structure. Fastened to the rail member 113 is a piston rod 114. Secured to the piston rod 114 is the nut member 98 illustrated in FIG. 27. Therefore, when the pin 112 is moved, during the rotation of the worm gear 111 through 180°, out of the position $112_1$ into the position $\mathbf{112}_2$, then also the nut member 98 (FIG. 27 is shifted out of the position 98 into the position $\mathbf{98}_2$ and the stop or impact member 101 arrives from the position $\mathbf{101}_5$ into the position $\mathbf{101}_1$.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A marine firing weapon containing a plurality of weapon barrels for use with a marine vessel for combating airborne targets both in zenith and in azimuth, comprising:

means defining an azimuth alignment axis;

means defining an elevation alignment axis;

a support device;

multi-barrel weapon means mounted for pivotable movement about said elevation alignment axis on said support device;

a substantially wedge-shaped socket upon which there is pivotably mounted said support device for pivotal movement about said azimuth alignment axis;

said azimuth alignment axis being inclined with respect to a vertical;

a respective ammunition magazine for each weapon barrel of the multi-barrel weapon means;

a respective elastic belt channel leading from a related one of said ammunition magazines to a related one of said weapon barrels;

a bent central substantially vertical column about which there are arranged said ammunition magazines;

said bent central substantially vertical column being provided at an upper end thereof with a bent portion merging with a substantially vertical column portion;

means for guiding said plurality of elastic belt channels along said bent central substantially vertical column from the stationary ammunition magazine to the individual weapon barrels;

said guiding means comprising:

a plurality of cage members rotatably mounted upon the substantially vertical column portion of the bent central substantially vertical column;

substantially vertical guide rails provided at each cage member for each elastic belt channel;

a respective substantially helical-shaped rail secured to the central substantially vertical column below a transition bend located between the vertical column portion and the bent portion of the bent central substantially vertical column and serving for lifting a related one of the elastic belt channels;

stop means for limiting the rotation of the cage members; and the range of rotational movement of the cage members being progressively stepwise greater from the bottom towards the top of the bent central substantially vertical column.

2. The marine firing weapon as defined in claim 1, wherein:

the weapon is pivotably mounted about the inclined azimuth alignment axis from a starting position in two rotational directions through a predetermined angle.

3. The marine firing weapon as defined in claim 1, further including:

an auxiliary drive arranged above each ammunition magazine and serving to retract a cartridge belt out of the related ammunition magazine; and drive means for continuously moving the related ammunition magazine during the removal of the cartridge belt.

4. The marine firing weapon as defined in claim 1, wherein:

the azimuth alignment axis is inclined with respect to the vertical through an angle in the range of 20° to 45°.

5. The marine firing weapon as defined in claim 4, wherein:

said angle amounts to approximately 35°.

6. A marine firing weapon system for a marine vessel for combating airborne targets, especially in zenith, comprising:

a column member having an outer surface along which there is moved an ammunition belt to a rotatable firing weapon;

an ammunition magazine arranged at the region of said column member for supplying an ammunition belt to the column member for movement along the outer surface thereof;

a flexible belt channel arranged at the outer surface of the column member;

said ammunition magazine delivering the ammunition belt with a length compensation loop to said flexible belt channel; and means cooperating with said column member for moving the flexible belt channel containing the ammunition belt along the outer surface of the column member along a substantially helical path during rotation of the rotatable firing weapon, whereby length changes of said flexible belt channel as it moves in said helical path along the outer surface of the column member are compensated by said length compensation loop.

7. The marine firing weapon as defined in claim 6, wherein:

said cooperating means comprises cage means for moving the flexible belt channel along the outer surface of the column member.

8. The marine firing weapon as defined in claim 6, wherein:

said column member comprises a vertical column portion merging with a bent column portion inclined at an angle to the vertical essentially corresponding to the angle of inclination of an azimuth alignment axis of the rotatable firing weapon.

9. The marine firing weapon as defined in claim 8, wherein:

said bent column portion is inclined at an angle in the range of 20° to 45°.

* * * * *

UNITED STATES PATENT AND TRADEMARK OFFICE

CERTIFICATE OF CORRECTION

PATENT NO. : 4,674,393

DATED : June 23, 1987

INVENTOR(S) : JEAN-MICHEL SCHAULIN et al

It is certified that error appears in the above-identified patent and that said Letters Patent is hereby corrected as shown below:

Column 1, line 11, after "Zenith" please insert --"-- (quotation mark)

Column 5, line 14, please delete "substantially" and insert --substantially--

Column 7, line 47, after "gear" please insert --48--

Column 12, line 65, after "FIG. 27" please insert --)-- (closed parentheses)

Signed and Sealed this

Sixteenth Day of February, 1988

*Attest:*

DONALD J. QUIGG

*Attesting Officer*

*Commissioner of Patents and Trademarks*